United States Patent [19]

Castro

[11] 3,999,647

[45] Dec. 28, 1976

[54] ENDLESS CHAIN STRUCTURE INCORPORATING A SERIES OF CAGES WITH A MECHANISM FOR VARYING THE DISTANCE BETWEEN THE SAID CAGES

[76] Inventor: Patricio Coira Castro, Avda. Pio XII, No 35 -9° , Pamplona, Spain

[22] Filed: Aug. 7, 1975

[21] Appl. No.: 602,658

Related U.S. Application Data

[63] Continuation-in-part of Ser. No. 366,854, June 4, 1973, abandoned.

[52] U.S. Cl. ..... 198/801; 198/792; 214/16.1 B; 214/16.1 BB

[51] Int. Cl.[2] ..... E04H 6/06

[58] Field of Search ..... 214/16.1 R, 16.1 B, 214/16.1 BB; 198/137–138, 110, 154

[56] References Cited

UNITED STATES PATENTS

| | | | |
|---|---|---|---|
| 3,405,795 | 10/1968 | Moscherpa | 214/16.1 B |
| 3,410,426 | 11/1968 | Fehlmann | 214/16.1 B |
| 3,688,921 | 9/1972 | Zaha | 214/16.1 B |
| 3,884,371 | 5/1975 | Castro | 198/110 X |

FOREIGN PATENTS OR APPLICATIONS

| | | | |
|---|---|---|---|
| 1,812,294 | 7/1969 | Germany | 198/792 |
| 677,546 | 12/1964 | Italy | 198/792 |

*Primary Examiner*—Frank E. Werner
*Assistant Examiner*—R. R. Johnson
*Attorney, Agent, or Firm*—Friedman, Goodman & Teitelbaum

[57] ABSTRACT

The present invention relates to an endless chain structure incorporating a series of cages with a mechanism for varying the distance between the cages. The cages are arranged in two rows, one above the other, and are very close together in the straight stretches. Each of the cages is attached to a mechanism for varying the distances which determine an increase or a reduction in the separation between the cages before or after, respectively their passage over end pulleys or wheels of the structure, so that a cage begins its ascent towards the upper level or its descent towards the lower level, following a curved line determined by the rim of the pulley, to avoid the cage in question from being reached or touched by the cage immediately following and travelling in a direction that is still rectilinear.

6 Claims, 6 Drawing Figures

ENDLESS CHAIN STRUCTURE INCORPORATING A SERIES OF CAGES WITH A MECHANISM FOR VARYING THE DISTANCE BETWEEN THE SAID CAGES

CROSS REFERENCE TO RELATED APPLICATION

The present invention is a continuation-in-part application of U.S. application Ser. No. 366,854, filed June 4, 1973, now abandoned.

BACKGROUND OF THE INVENTION

The present invention is concerned with an endless chain structure incorporating a series of cages, with a mechanism for varying the distance between the said cages.

A structure of this type can have many applications, among which there may be mentioned the storage of voluminous and heavy bodies, for example, cars, which are arranged in two rows, one above the other, and with the possibility that any of the cages can be brought into a position facing the place where it is to be loaded or unloaded.

Each one of the cages has dimensions suitable to contain the body or car to be stored and, in the straight stretches of the structure, the cages are arranged very close together in order to make maximum use of the space. But during the passage over the end wheels of the structure, a greater separation is necessary to avoid the cage that is beginning its ascent towards the upper level or its descent towards the lower level, following a curved line determined by the rim of the end pulley or wheel of the structure, from being reached or touched by the cage immediately following it and which is still travelling in a rectilinear direction.

A similar device having similar support structure and systems is disclosed in applicant's U.S. Pat. No. 3,884,371, granted May 20, 1975, to which reference may be made for like parts, structure and functions.

SUMMARY OF THE INVENTION

The problems of the prior art are solved with the mechanism of the present invention for varying distances that is attached to the suspension members of the cages, and that makes it possible to cause the cages to approach or recede from one another, without interfering with the operation of the device. The distance that is to be varied is that necessary to avoid all interference between the cages during their passage over the end pulleys of the structure. This distance is determined by the following formula:

$$D = \pi R + a$$

in which:

$R$ = radius of the pulley of the structure;

$a$ = width of the cage; and $D$ = distance between two consecutive cages.

The variation of distance is effected by a slide mechanism which is automatically driven by any appropriate procedure, such as:

a. Support on guides appropriately situated for the purpose;

b. A system of hydraulic or pneumatic rods, appropriately programmed, and c. An electric system for winding and unwinding the hauling cable, the system being appropriately programmed; as indicated in the above-mentioned U.S. Pat. No. 3,884,371.

The variation of distance effected by means of the mechanism of the present invention is brought about without alteration of the points of stress or of the direction of the hauling cables, which can move in both directions and attain the same results with respect to the mechanism described.

The variation obtained by means of the slide mechanism requires that the latter be able to effect a movement, the length of which is exactly equal to the reduction or increase in distance required in the event of the slides being linked in a simple form (fixed cable ends), or a movement equal to half the distance in the event of the cable ends being connected with another slide.

During the functioning of the endless chain structure, on the displacement of one slide being produced, there will be automatically produced the displacement of another in the opposite direction, with the result that the length of the complex is maintained invariable. This enables a uniform traction to be applied to the system.

Accordingly, it is an object of the present invention to provide a mechanism for varying the distances between cages which overcomes the disadvantages of the prior art.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DETAILED DESCRIPTION OF THE PREFERRED EMBODIMENT

Figure 1:
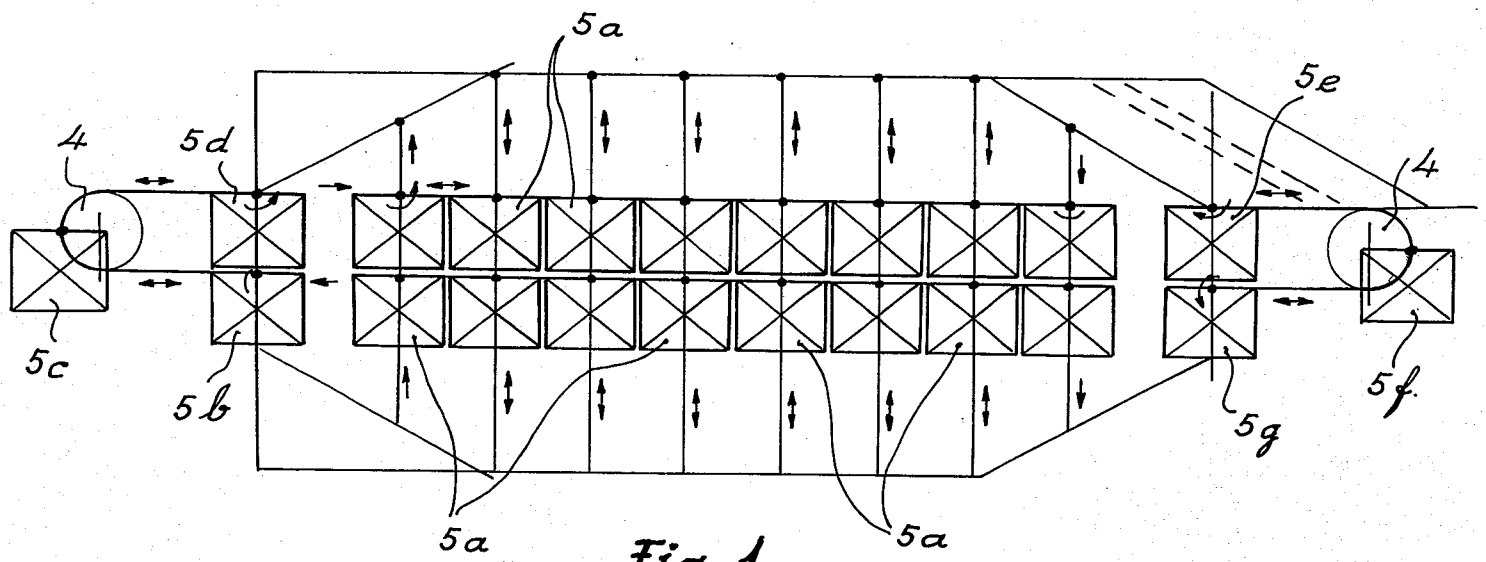
FIG. 1 shows a diagrammatic view of the arrangement of the endless chain structure according to a frontal elevation, on which is superimposed a diagram of the directions in which the force is exerted on the cables supporting the series of cages, in accordance with the invention.

In the illustrations and in the following description, the elements constituting the structure and its principal parts have been designated in accordance with the following nomenclature:

1 — Tubular piece
2 — Guide block
3 — **3*a*** — Traction cables
4 — Pulleys
5 — **5*a*, 5*b*, 5*c*, 5*d*, 5*e*, 5*f*, 5*g*** — Cages
6 — Slide
7 — Diametric cross-piece
8 — Diametric cross-piece 9 — Sheaves
10 — Anchorage
11 — Anchorage
12 — Vertical cuts or slots
13 — Horizontal cuts or slots
14 — Plates
15 — Vertical girders
16 — Tracks
17 — Endless chains
18 — Pinions
19 — Check pieces
20 — Semicircular tracks With reference to the above-mentioned illustrations, it can be seen that the elements constituting the endless chain structure in accordance with the invention are various:

A static part constituted by the stationary support structures 15, 16 which hold the shafts of the pulleys 4 and guides the cages 5 durng their travel, and like stationary elements 19 of the structure.

A dynamic part constituted by the cages 5 and elements 1 and 14 secured thereto which move relative to the stationary support structure, and like members such as cabins, platforms, etc.

A control system consisting of conventional means 17 and 18 for regulation of the functions for starting and stopping the movement of the cages 5 and the like.

A hauling system constituted by a conventional motor-reducer (not shown) for regulating the power to be utilized, by the couplings of the cables 3 and 3*a* to the pulleys 4, by the driving wheels or pulleys 4, by the cables 3 and 3*a*, and by the support of the cage 5 by the tubular piece 1.

The components of these constituent elements may be variable, and in each case will be those most appropriate to comply with the mission assigned to them. The majority of these elements are well known in the prior art and are available on the open market, and different solutions can be organized with them.

Figure 3:
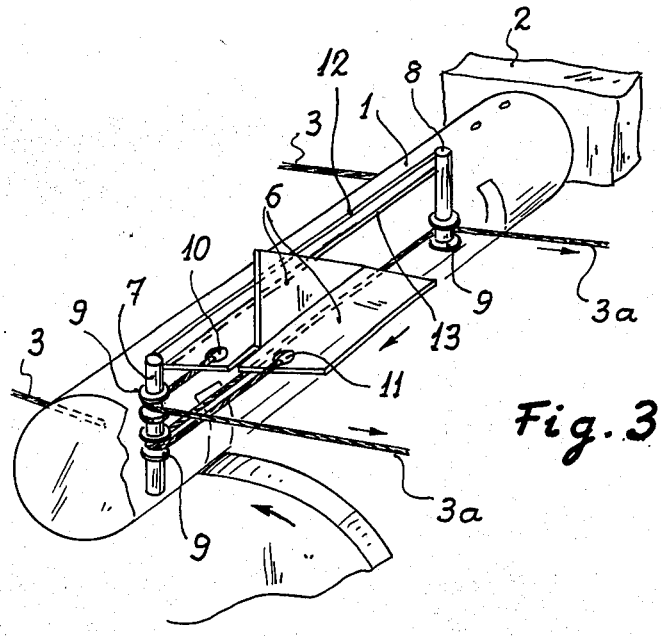
FIG. 3 shows a perspective view, partially cut away, of the slide mechanism that serves as a support from which a cage is hung.
Figure 4:
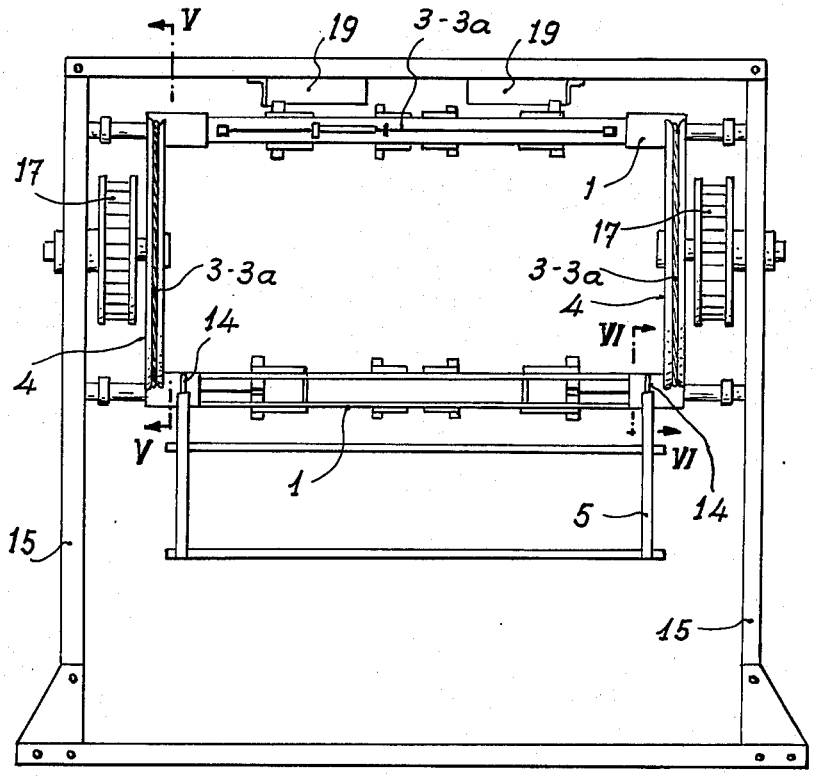
FIG. 4 shows in detail, on a larger scale, an end elevational view of the structure diagrammatically shown in FIG. 1, with parts being eliminated for greater clarity of the drawing.
Figure 5:
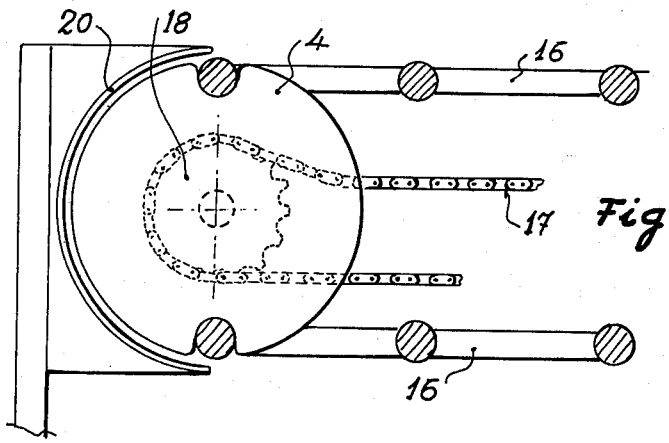
FIG. 5 shows a cross sectional view taken along the line V—V in FIG. 4.

The essential characteristics on which there is based the correct and adequate functioning of the endless chain of cages which is advocated, is the slide mechanism which is illustrated in FIG. 3, which includes a tubular hollow piece 1, at least one of whose ends is fitted with a guide block 2. The guide block 2 is supported and guided on either the upper or lower tracks 16, best shown in FIG. 5, as the cage 5 moves in the horizontal direction longitudinally through the structure. Upon reaching the end of the track 16, the ends of tubular piece 1 are each engaged in an opening in each of the two end wheels 4 and the guide block 2 rides along the semicircular track 20 to the other track 16, to either raise or lower the cage 5. Each of the four pulleys or wheels 4 is secured to a pinion 18, there being two at each end as shown in FIGS. 4 and 5, which is driven or rotated by one of the two endless chains 17 mounted thereon on each side of the structure. Each chain 17 is driven by conventional means including a motor-reducer which are well known in the art, where no further discussion is thought necessary.

Figure 2:
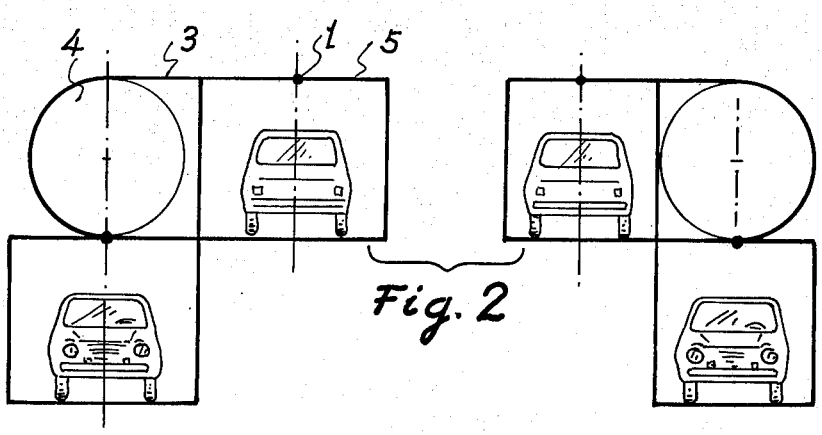
FIG. 2 shows, on a larger scale, a detail that schematically illustrates the two ends of the structure.
Figure 6:
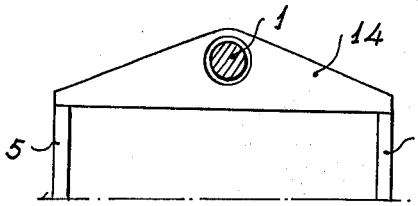
FIG. 6 shows a cross sectional view taken along the line VI—VI in FIG. 4.

The tubular piece 1 transversely crosses over the two traction cables 3 which are parallel to one another, as shown in FIG. 3, and pass over the two pairs of pulleys 4 or end wheels of the endless chain structure, as best shown in FIG. 4. The tubular piece 1, in a conventional manner well known in the art, serves as an element for supporting a cage 5 of prismatic form and appropriate dimensions, being disposed at the upper central portions 14 of the cage 5 as shown in FIGS. 2, 4 and 6.

The cages 5 are constituted by rigid beams and girders which define the edges of a parallelopipe, having vertical rigid plates 14 connecting the top portions of the vertical girders of each cage 5. The plates 14 of each cage are provided with confronting openings in which the ends of the corresponding tubular piece 1 are housed so that the cage hangs from the tubular piece 1 and is free to swing relative to the tubular piece 1. Thus, when the motor drives the endless chains 17, the chains 17 in turn rotate the associated pinions 18 and the wheels 4 connected thereto. The wheels 4 haul the traction cables 3, 3*a* to move the guide blocks 2 along one of the tracks 16 to the end thereof, and then carries the ends of the tubular pieces 1, in the openings provided therefor, to the other of the tracks 16 where the cages begin their run in an opposite direction. If each tubular piece 1 is provided with a guide block 2 at each end thereof, then two horizontally spaced apart tracks 16 will be provided at both the upper and lower positions to support the respective guide blocks 2.

The hollow tubular piece 1 is provided with two longitudinal cuts 12 and 13 perpendicular to each other, which pass its walls over diametrically perpendicular planes to define four grooves or slots 90° apart in the exterior of the tubular piece 1, in which there is guided a slide 6. The slide 6 has a section in the form of a cross, each of whose arms is guided in one of the four grooves, which permit the terminal parts of the arms of the cross, or wings of the piece, to project to the exterior. The vertical arms of the slide 6 extend through the vertically spaced apart slots 12, and the horizontal arms of the slide 6 extend through the horizontally spaced apart slots 13, as best shown in the cut-away view of FIG. 3.

The terminal parts of the slide 6 have the appropriate form so that the check pieces 19 can act on them, by thrusting, coupling, etc., to bring about the lateral movements of the slide 6 towards one or other end of the tubular piece 1. The check pieces 19, in a modified form as shown in FIG. 4, are two rigid bars placed in an upper horizontal plane for the upper cage, and two rigid bars (not shown for clarity) placed in a lower horizontal plane for the lower cages. The bars of each pair converge together from one end of the structure where each bar is horizontally inclined towards the center, run parallel to each other along a major intermediate portion of the structure, and then diverge apart again towards the other end of the structure where each bar is horizontally inclined away from the center, so that the bars of each pair are closer together in the intermediate portion of the structure, and further apart at each end of the structure. The upper vertical arm of each slide of the modified tubular piece 1 is engaged in one of the check pieces 19 so that the check piece 19 cause the displacement of the slide and consequently the increase or reduction of the relative separation between the consecutive cages 5 due to the particular run of the cables 3, 3*a*.

It is noted that the modified tubular piece 1 shown in FIG. 4 is provided with two slides, however the preferred mechanism of the present invention functions as well with only one slide 6 provided in each tubular piece 1, as shown in FIG. 3 which will be discussed beow. Furthermore, with only one slide 6, only one upper check piece bar 19 and one lower check piece 19 is required, the bars having a similar configuration as mentioned above where the bars horizontally incline towards and away from opposite longitudinal sides of the structure at the ends thereof, respectively.

Referring to FIG. 3, the traction cables 3 proceeding from the mechanism of the anterior slide of the preferred tubular piece 1. At these ends the tubular piece the tubular piece 1. At these ends the tubular piece has two diametric cross-pieces 7 and 8, rotatory or with a rotation of some sheaves 9 provided on them. The sheaves 9, according to the case, can be fixed or not, and receive the cables 3*a* which link the slide mechanism with the tubular piece of the cage which follows it. One of the ends of these cables 3*a* is connected in the anchorage 10 of the slide 6, and passing over the upper sheave 9 of the diametric cross-piece 7 becomes directly joined to the tubular piece of the following cage. The end of the other cable 3*a* is connected in the anchorage 11 on the same side of the slide 6, and passing over the lower sheave 9 of the diametric cross-piece 7, retrocedes through the interior of the tubular piece 1 and passes over the sheave 9 of the diametric cross-piece 8, and moves towards the tubular piece of the following cage in a direction parallel to that of the other cable, and with joint forward and backward movements by means of which there is permanently maintained the parallelism between the different slide mechanisms of the system.

Thus, as shown above and indicated in FIG. 3, the lateral movement of the slide 6 by the check piece 19 toward the end of the tubular piece 1 having the cross-piece 7, lets out the cables 3*a* to increase the distance between this cage 5 and the cage which follows it. Accordingly, the opposite lateral movement of the slide 6 by the check piece 19 toward the opposing end of the tubular piece 1 having the cross-piece 8, draws in the cables 3*a* to decrease the distances between this cage 5 and the cage which follows it.

If desired, the tubular piece 1 can be modified to include two slides as shown in FIG. 4, where one cable 3*a* would be connected to one of the slides, and the other cable 3*a* would be connected to the other slide, where the movement of the slides toward and away from each other on each half of the tubular piece would decrease or increase the distances between the cages. However, the single slide 6 in each tubular member 1 is preferred, where the single slide 6 has a lateral movement across the tubular piece 1 so that movement towards one end lets out the cables 3*a* and movement towards the opposite end draws in the cables 3*a*. Therefore, no further discussion of the modified two slides-tubular piece is thought necessary.

In the diagram of FIG. 1 there is illustrated the functioning of the system, and in it there can be seen the cages 5*a* which remain very close together in the centre of the structure. In the case when the system travels in a clockwise direction, the cage 5*b* has begun its advance movement on drawing near to the left end of the structure, to be able to ascent without interference. Passing through the intermediate position illustrated with the cage 5*c*, the cage becomes situated in the upper row and in the position 5*d* to draw near to the cages that are closer to one another as cage 5*a*. Simultaneously with the advance of the cage 5*b*, there is produced the advance of cage 5*e* of the upper row, which begins the descent. Passing through the position 5*f* of the right end of the structure, the cage becomes situated in the lower row and begins, in position 5*g* to approach the cages that are close to one another as cage 5*e*.

All these variations are effected jointly and simultaneously, compensating each other with the result that the length of the hauling cable constituted by the sections 3, 3*a*, 3*b*, etc., brought into service by the different slide mechanisms, is always the same. The functioning of the system, as set forth above, produces stresses or forces causing displacements of the cables 3 and 3*a* in the interior of the tubular pieces 1 as shown by way of arrows in FIG. 1. Obviously, the double arrows signify equal stresses in opposite directions, and no displacement, while the single headed arrows signify unidirectional stresses in the direction shown and therefore displacement. Additionally, the rotational arrows indicate a change or turning in the direction of the stresses about the tubular piece 1 of the cages adjacent to the pulleys 4. These stresses take place in a horizontal plane, even though the scheme of the forces has been superimposed on the elevational view in a vertical plane to better identify the points at which the forces take place along the run of the tubular piece 1.

The structure, as best shown in FIG. 4, is formed by pairs of vertical beams 15, which vary in number according to the length of the structure. The upper ends of the beams 15 are connected to the two upper tracks or girders 16 disposed in the same horizontal plane, with the lower two tracks or girders 16 being connected to lower portions of the beams 15 in a lower horizontal plane. The tracks 16 have a U-shape with their wings confronting each other to serve as guides for the guide blocks to ride along, as mentioned above.

The installation is designed in such a manner that there exists at least one point where there can be carried out the loading and unloading of the string of cages 5, each one of which can be situated in a position facing the said position, or two positions if it pertains to the upper level and the lower level. Thus, as shown above the cables 3, 3*a*, etc. provide a continuous and closed arrangement extending from a slide member of one cage to the tubular piece of the next cage, and so on, etc., for defining an endless chain structure of the present invention.

The circumstances of size, form and material of each of the elements that constitute the whole can be varied; there may be varied in the complex all that which does not imply an alteration of the essence of the purpose expounded in the preceding description, which should be taken in its widest sense and not as a limitation of possibilities of embodiment.

What is claimed is:

1. An endless chain structure comprising a plurality of cages arranged in two super-imposed horizontal rows, said cages being relatively close together in straight stretches and relatively far apart in curved transition stretches, said curved transition stretches being disposed at opposite ends of said structure, each cage including a transverse tubular member for supporting its associated cage, cable means connected to each tubular member for moving said cages, terminal pulleys located at said ends of said structure for driving said cable means, movable means provided on each said tubular member and connected to said cable means for increasing and decreasing distances between said cages when said cages travel between said straight stretches and said curved transition stretches, said movable means having a lateral movement across said tubular member between opposite ends of said tubular member, said lateral movement of said movable means toward one end of said tubular member letting out said cable means to increase the distance between said cages for said curved transition stretches, and said lateral movement of said movable means toward the opposite end of said tubular member drawing in said cable means to decrease the distance between said cages for said straight stretches, whereby one of said cages beginning its ascent towards an upper level or its descent toward a lower level, during said curved transition stretches at said opposite ends of said structure, avoids contact with an adjacent cage.

2. An endless chain structure as claimed in claim 1, wherein said movable means include a slide member having four arms to define a cross in cross-section, said slide member being disposed within said tubular member with said arms projecting out of said tubular member through associated grooves provided in said tubular member, adjacent arms of said slide member being perpendicular to each other, said cable means being connected to said slide member.

3. An endless chain structure as claimed in claim 2, wherein said cable means are connected to two of said arms of said slide member, said two arms being in the same plane 180° apart.

4. An endless chain structure as claimed in claim 2, including two diametral cross-pieces vertically disposed at said opposite ends of said tubular member, said slide member being disposed between said cross-pieces, said cable means including one cable connected to one of said arms of said slide member and extending about one of said cross-pieces for attachment to the tubular member of a following cage, and another cable connected to another one of said arms of said slide member and extending completely around said one cross-piece to pass through said tubular member and about the other of said cross-pieces to parallel said one cable for attachment to the tubular member of said following cage.

5. An endless chain structure as claimed in claim 4, including a sheave rotatory mounted on said other cross-piece to receive said another cable, and two sheaves rotatory mounted on said one cross-piece, one of said two sheaves receiving said one cable and the other of said two sheaves receiving said another cable.

6. An endless chain structure as claimed in claim 4, wherein said cable means include third and fourth parallel cables connected to said tubular member and extending to the movable means of a proceeding cage to provide a continuous and closed arrangement of cables defining said endless chain structure.

* * * * *